United States Patent [19]

Kistner et al.

[11] Patent Number: 4,629,667

[45] Date of Patent: Dec. 16, 1986

[54] WHITE REFLECTIVE COATING

[75] Inventors: John F. Kistner, Oakdale; Donald R. Hotchkiss, Maplewood, both of Minn.

[73] Assignee: Minnesota Mining and Manufacturing Company, St. Paul, Minn.

[21] Appl. No.: 717,530

[22] Filed: Mar. 29, 1985

[51] Int. Cl.[4] ..... G03C 1/96; G03C 1/86; G03C 9/00

[52] U.S. Cl. ..... 430/11; 430/14; 430/15; 430/510; 430/946; 430/950; 430/961

[58] Field of Search ..... 430/11, 14, 15, 220, 430/510, 946, 950, 961; 354/112

[56] References Cited

U.S. PATENT DOCUMENTS

| | | | |
|---|---|---|---|
| 2,956,879 | 10/1960 | Van Campen | 430/561 |
| 3,619,155 | 11/1971 | Young | 430/220 |
| 3,751,258 | 8/1973 | Howe et al. | 430/946 |
| 4,269,916 | 5/1981 | Bilofsky et al. | 430/14 |

*Primary Examiner*—Richard L. Schilling
*Attorney, Agent, or Firm*—Donald M. Sell; James A. Smith; Mark A. Litman

[57] ABSTRACT

A coating composition for the backside of photographic prints and photographic prints so coated are described. The white coating is reflective, flexible, and water resistant.

10 Claims, No Drawings

WHITE REFLECTIVE COATING

BACKGROUND OF THE INVENTION

1. Field of the Invention

Three-dimensional, autostereographic prints with lenticular surfaces are described. Reflective backside coating compositions and processes essential to the manufacture of the three-dimensional prints are also described.

2. Background of the Art

Stereo-optical images have been available for many years. Almost all of them are based upon the same principle of displaying multiple images (i.e., at least two images) at the same time, each image displaying the same scene from a different perspective, approximating the different perspectives that would be seen by the left and right eye. Each image is then simultaneously displayed in a manner that enables each eye to view its appropriate image. With each eye receiving an image with an appropriate perspective, a scene with natural depth to it is seen.

The old 'stereopticons' and modern three-dimensional viewers for children provide separate images which are viewed through separate eyepieces to provide the different perspectives. More modern three-dimensional photographic images, such as that shown in U.S. Pat. No. 3,751,258 have a lenticular surface over multiple images. The optical effect of the lenticles is to direct the transmitted optical images towards the appropriate viewing eye. U.S. Pat. No. 3,751,258 requires that a reflective backing layer be attached to the radiation-sensitive element and that the reflective backing layer be permeable to the baths or other means required to process the radiation-sensitive element to a visible image. The properties necessary in formulating a reflective backing layer with those properties has proven to be difficult to achieve in actual practice. A presently commercial embodiment of this technology has between ten and twelve layers coated onto the lenticular surface and requires two or three passes on coating apparatus to lay those layers onto the surface. That is a complex and expensive procedure.

SUMMARY OF THE INVENTION

According to the present invention, a radiation-sensitive image forming means is coated onto a lenticular surface and no reflective backing layer is initially present. After complete development of the image, the reflective backing layer is coated over the image. The coating composition and the final coating must have particular properties in order to provide the optical properties necessary in the backing without adversely affecting the finished image.

DETAILED DESCRIPTION OF THE INVENTION

The present invention describes a three-dimensional autostereographic print having a coated reflective backing on the side of the image containing layer or layers away from the lenticular surface of the print. The present invention also describes a process for making such an autostereographic print by first developing the multiple perspective image and then coating the backside of the image with a reflective coating composition. Coating compositions useful in providing the reflective backside coating are also described as part of the present invention.

The printing stock used in the practice of the present invention comprises a lenticular surface having a multiplicity (at least two) of perspective images of the same scene in optical registry with the refractive ability of the lenticular surface. The images may be in black-and-white or in color and may be in any format (e.g., silver halide photographic images, photographic dye images, printed images, photothermographic images, diazo images, electrophotographic images, etc.). Preferably the images are color photographic images in hydrophilic colloid binders such as gelatin. The perspective images may be in one or more layers which constitute the image medium. One surface of the image medium faces or is bonded to the non-lenticular face of the lenticular element forming the viewing surface. Layers intermediate the lenticular element and the image medium may be present to enhance bonding (e.g., primer or spacer layers) or to provide additional optical effects, but in general the optical element will be directly bonded to the lenticular element or with at most a protective or adhesion enhancing layer between them. The side of the optical element facing the lenticular layer is referred to as the front side of the optical element and the other side is referred to as the backside of the optical element.

Ordinarily and in the preferred mode of practicing the present invention, the optical element is transparent except for the presence of materials which constitute the image. For example, photographic image containing optical elements would comprise hydrophilic colloidal binder with only dyes and/or silver present as visually observable components within the optical element. Printed images or electrophotographic images would be made on transparent polymeric film. Once the image containing optical element is engaged with the lenticular surface, the reflective coating is then applied to the backside of the optical element to provide a three-dimensional, autostereographic print viewable by reflective lighting.

The physical and optical properties for the reflective coating are critical to the performance and durability of the print. The required combination of properties are not easily achieved and the particular properties needed to practice the above-described technology have not been previously recognized in the art. Particuarly when used in combination with photographic images in the optical element, the requirements of the coated reflective layer and the coating composition used to make that layer are stringent.

To be used with finished images and particularly photographic images in the optical element, the coating composition must have at least the following properties:

(1) A water-based binder composition (i.e., with less than 4% by volume of any volatile organic solvents for photographic dyes), (2) Good adhesion characteristics to hydrophilic colloid layers, and (3) Non-reactive with the photographic image.

Additionally, the dried reflective backing layer must have the properties necessary to perform its function, including:

(1) Water-insolubility, (2) Flexibility, (3) Reflectivity, (4) Integrity, and (5) Desired degree of opacity.

These combinations of properties and the changes in properties from the coating composition (e.g., water-based) to the dried reflective layer (e.g., water-insoluble) are not easily achieved. The present invention describes compositions which are able to perform all of these requirements and provide even additional benefits to a photographic print.

The coating composition of the present invention comprises at least the following components: (1) white particulate reflective pigments, (2) crosslinkable water-soluble polymeric binder, (3) water-soluble crosslinking agent for the polymeric binder, and (4) water. Preferably the composition of the present invention also contains a water-soluble flexibilizer, water-soluble humectant, and water-soluble surfactant.

White particulate reflective pigments are well known in the imaging technologies. Titania pigments are by far the pigment of choice because of their high reflectivity. U.S. Pat. No. 3,751,258 discloses the use of titania pigments as well as zinc oxide and barium sulfate. Lamellar titania flakes with high aspect ratios and enhanced reflectivity are also known to be used as reflective pigments (e.g., U.S. Pat. No. 4,216,018). Calcium carbonate and other metal oxides are also available as white pigments, alone or in combination with titania.

A few water-soluble polymeric binders are known to be crosslinkable. Poly(vinyl alcohol) is the water-soluble binder of choice in this regard. Poly(vinyl pyrrolidone) is known to be tannable, gelatin is of course crosslinkable and constitutes a natural polymer rather than a synthetic polymer, and other water-soluble polymers are or may be modified to be crosslinkable. Polymers may be rendered crosslinkable by the addition of substituent or pendant groups to the polymer backbone which can react with crosslinking agents. For example, hydroxyl substituent groups could be added to the polymer background which would be crosslinked by aldehyde or organic titanate crosslinking agents. As previously noted, however, poly(vinyl alcohol) is the water-soluble polymer binder of choice. Any poly(vinyl alcohol) film forming binder will work in the practice of the present invention although the more hydrolized poly(vinyl alcohol)s are preferred. The greater the degree of hydrolysis of the polymer, the lower the water sensitivity of the final coating. Poly(vinyl alcohol) with only 85% hydrolysis, of course, works in the practice of the present invention, poly(vinyl alcohol) with 95% hydrolysis performs better in the present invention, and poly(vinyl alcohol)s which are 98% or more hydrolyzed (e.g., 99% or 100% hydrolyzed) provide the least water sensitive coatings.

Water-soluble crosslinking agents for the water-soluble polymeric binders are well known in the art and are commercially available. Melamine-formaldehyde water-soluble resins are sold commercially as crosslinking agents for poly(vinyl alcohol) (e.g., Cymel 385, American Cyanamid, methylated melamine-formaldehyde resin with a low degree of alkylation). Polyalcohols and polyacids are other materials that can act as water-soluble crosslinking agents for various water-soluble polymers.

A general range by weight for the required components of the basic coating composition of the present invention is 30–85% by water, 12–52% white pigment (for reflective viewing, and 0.1 to 15% for transmissive viewing), 0.25 to 12% water-soluble binder, and 0.05 to 6% water-soluble crosslinking agent. A preferred range would be 45–75% water, 20–30% white pigment, 1 to 6% water-soluble binder and 0.5 to 4% crosslinking agent.

Other additives already alluded to may also be present in more preferred compositions of the present invention. Water-soluble flexibilizing agents are useful in providing a more flexible coating on the back of the print. Polyalkylene glycols such as water-soluble polyethylene glycol and polypropylene glycol (low molecular weight) are particularly useful for this purpose. Polyethylene glycols having molecular weights between 100 and 1000 are highly suitable for the practice of the present invention. Those materials not only act as flexibilizers, but also act as humectants, absorbing moisture and preventing the coating from becoming too brittle. Poly(oxyalkylene) polymers can also act as humectants and in some cases can also be flexibilizers.

Water-soluble surfactants are very useful as coating aids. They assist in the formation of smooth, bubble-free reflective coatings. There are many water-soluble surfactants commercially available, particularly poly(dimethyl silicone) alcohols such as surfactant DC-193 (Dow Corning).

Crosslinking accelerators may also be added to the mixture prior to coating to speed up the curing of the reflective backing layer. For example, in using the preferred components of poly(vinyl alcohol) and melamine-formaldehyde resin crosslinking agent, the presence of acids increases the rate of crosslinking. Water-soluble acids such as hydrochloric acid, hydrobromic acid, sulfuric acid, nitric acid, succinic acid, sulfamic acid, acetic acid, citric acid, fumaric acid, lactic acid, maleic acid, fluoroboric acid, hexafluoroantimonic acid, and phosphoric acid are particularly desirable crosslinking accelerators. The most preferred acids are colorless, have low volatility, and have at least one proton with an ionization constant ($K_a$) within the range of $1\times10^{-2}$ and $1\times10^{-8}$.

A general composition range by weight for preferred coatings according to the present invention would be 30–85% water, 0.1 to 52% white pigment, 0.25 to 12% water-soluble polymer binder, 0.05 to 6% water-soluble crosslinking agent, 0 to 10% (0.25 to 10%) flexibilizer and/or humectant, 0 to 3% (0.10 to 3%) surfactant, and 0 to 8% (0.25 to 8%) crosslinking accelerator.

The final coating of the present invention would have most or substantially all of the water removed therefrom (except that generally in equilibrium with the environment). The proportions by weight of materials in the dried film, as derived from the individual ingredients since some are now reacted with each other, would generally be 0.5–85% white pigment, 1–50% water-soluble binder, 0.2 to 25% crosslinking agent, 0 to 20% (0.5 to 20%) flexibilizer and/or humectant, 0 to 5% (0.25 to 5%) surfactant, and 0–15% (0.5 to 15%) crosslinking accelerator.

Certain terms used in describing the properties of the present invention have definite meanings in the art. When the final print is described as flexible, this means that it can conform to a mandrel having a diameter of three (3) inches (7.6 cm) without cracking. Preferred constructions in the practice of the present invention can conform to mandrels with less than 5 mm diameters without cracking of the coated reflective layer. When the integrity of the coated reflective layer is mentioned, it is meant that after mild rubbing to remove processing residues, the coating layer will not readily be removed by handling. This means that if the print is gripped between a thumb and index finger with a force of 1 to 2 lbs per square inch (70 to 140 g/cm$^2$) and the print is pulled away from between the fingers, that less than 1% of the coating would be removed. Water-repellancy means that when a drop of water is placed on the backing layer and wiped away within five seconds with a soft tissue, there has been no permanent visible effect upon the image in the optical layer on either side of the print.

The reflective backing layer can be either substantially opaque or translucent. If the layer is opaque it is viewable only by reflective illumination. If it is translucent, it is viewable by either reflected or transmitted light. A translucent backing may allow up to 90% of transmitted visible radiation through the layer and still provide a print viewable by reflected light. Preferably the backside reflective coating allows no more than 50% transmission of light. More preferably it allows no more than 20% transmission of light, and most preferably the reflective layer allows no more than 15% transmission of visible light.

The physical construction of the present article, in having the dried, crosslinked polymer backing layer over the emulsion, has a number of resultant advantages. Corrective tints can be easily added to the backcoating to correct for small deviations in color rendition due to the negative, the imaging system in the optical element, or lighting during the original image recordation. Conventional photographic dyes or whiteners can be added to the reflective layer to accomplish this. The present construction can provide a thicker, more stable and more reflective backing layer. The previous constructions required a thin pigmented layer to enable penetration of the layer by the developer. Because the layers were previously thin, there was less available pigment for providing a white background. The reflective backing of the present invention can be as thick as desired since they are provided after the image is present in its finished state on the back of the lenticular element. Ordinarily the reflective backing layer is from $1\times10^{-5}$ to $1\times10^{-3}$ meters thick, preferably between $1.5\times10^{-5}$ and $2\times10^{-4}$ meters. The reflective backing can also be made water-repellant while backing layers on previous photographic constructions had to be readily penetrable by aqueous solutions. The water-repellancy of the present construction reduces the likelihood of subsequent damage to the print by aqueous solutions.

The following discussion provides a description of useful process conditions for applying the composition of the present invention to a print associated with a lenticular viewing layer. To begin the process, a multiplicity of finished perspective images in a layer or multiplicity of layers forming an optical element are secured to the back surface of a lenticular element or lenticular sheet. The association of the perspective images with the lenticular element at this point provides an autostereoscopic article viewable by transmission of light. A lenticular surface of the lenticular element is away from the side of the lenticular element carrying the perspective images. The coating composition is then applied as a liquid coating on the available surface of the optical element. The coating is then dried (preferably at elevated temperatures such as 65°–95° C., more preferably 70°–85° C.) to remove at least 80% of the water. Preferably more than 90% of the water is removed. Crosslinking of the crosslinkable, water-soluble polymer binder is then initiated. In the case of poly(vinyl alcohol), melamine-formaldehyde crosslinking agent, and acid accelerator, continued heating at the drying temperatures will cure the coating. Total combined drying and curing time may range from about two to eight minutes depending upon the thickness of the coating and the temperatures used to dry and cure the coating. The crosslinking agent may also be chosen to be activated by radiation, as many photosensitive crosslinking agents or activators are known in the art.

These and other aspects of the present invention will be illustrated by the following non-limiting example.

EXAMPLE

A lenticular sheet of cellulose acetate having a thickness of about 0.25 mm was embossed to form cylindrical lenticules having diameters of about 0.2 mm in diameter. This provided approximately 150 lenticules per inch on the front surface of the lenticular sheet. The back surface of the lenticular sheet was coated with a conventional negative acting tri-pack construction of color-forming silver halide/gelatin emulsion layers as generally used in the manufacture of color photographic paper stock. The layers comprised, in order from the backside of the lenticular sheet:

(1) a red-sensitive silver halide/gelatin emulsion containing a magenta dye-forming coupler,
(2) a gelatin interlayer,
(3) a green-sensitive silver halide/gelatin emulsion containing a cyan dye-forming coupler,
(4) a gelatin spacer layer containing an ultraviolet radiation absorbing compound,
(5) a blue-sensitive silver halide/gelatin emulsion containing a yellow dye-forming layer, and
(6) a gelatin Protective layer.

The dried and coated emulsions on the lenticular sheet were exposed to light through photographic negatives of two perspective images. The emulsions were then developed, bleached and fixed according to standard color photographic procedures. At this point the article provided a three-dimensional, autostereographic article viewable by transmissive illumination.

The gelatin protective layer is then coated with a $7.6\times10^{-5}$ meter wet coating of a composition comprising in parts by weight

| | |
|---|---|
| 66.7 | Distilled water |
| 23.5 | Titania |
| 3.4 | Polyethylene glycol (MW 200) |
| 2.4 | Poly(vinyl alcohol) (99% hydrolyzed) |
| 2.2 | Lactic acid |
| 1.4 | Melamine-formaldehyde resin (Cymel 385) |
| 0.4 | Poly(dimethyl silicone) alcohol, Surfactant DC-193 |

We claim:

1. An autostereographic print comprising a lenticular element having a lenticular front surface and a non-lenticular back surface, secured to said non-lenticular back surface one surface of a transparent optical element having at least two perspective images, and secured to the other surface of said optical element a backing layer comprising the dried and crosslinked product of a composition comprising by weight:

0.1 to 52% of a white pigment
0.25 to 12% of a water-soluble, crosslinkable, synthetic polymeric binder,
0.05 to 6% of a water-soluble crosslinking agent comprising a melamine-formaldehyde water-soluble resin for said water-soluble crosslinkable binder, and 30 to 80% water.

2. The print of claim 1 wherein said optical element comprises a color photographic image.

3. The print of claim 2 wherein said backing layer comprises 0.5 to 85% white pigment 1.50% water-soluble binder, and 0.2 to 25% water-soluble crosslinking agent for said binder, said binder and said crosslinking agent being at least in part coreacted.

4. The print of claim 3 wherein said backing layer further comprises 0.5 to 20% flexibilizer, and 0.25 to 5% surfactant.

5. The print of claim 3 further comprising from 0.5 to 15% of a crosslinking accelerator.

6. A process for producing an autostereographic print comprising:

(a) providing at least two perspective images in an optical element which is secured to a non-lenticular surface of a lenticular sheet, (b) coating the surface of said optical element which is not secured to said lenticular sheet with a composition comprising by weight 0.1 to 52% of a white pigment 0.25 to 12% of a water-soluble, crosslinkable, synthetic polymeric binder, 0.05 to 6% of a water-soluble crosslinking agent comprising a melamine-formaldehyde water-soluble resin for said water-soluble crosslinkable binder, and 30 to 80% water, and (c) drying and curing said composition.

7. The print of claim 1 wherein said polymeric binder comprises poly(vinyl alcohol) with at least 95% hydrolysis.

8. The print of claim 1 wherein said water-soluble crosslinking agent consists essentially of a melamine-formaldehyde water-soluble resin.

9. The process of claim 6 wherein said polymeric binder comprises poly(vinyl alcohol) with at least 95% hydrolysis.

10. The process of claim 9 wherein said water-soluble crosslinking agent consists essentially of a melamine-formaldehyde water-soluble resin.

* * * * *